US005994828A

United States Patent [19]

De Zwart et al.

[11] Patent Number: 5,994,828

[45] Date of Patent: Nov. 30, 1999

[54] PICTURE DISPLAY DEVICE WITH ADDRESSING SYSTEM

[75] Inventors: Siebe T. De Zwart; Gerardus G. P. Van Gorkom; Theunis S. Baller, all of Eindhoven, Netherlands

[73] Assignee: U.S. Philips Corporation, New York, N.Y.

[21] Appl. No.: 09/020,926

[22] Filed: Feb. 9, 1998

[30] Foreign Application Priority Data

Feb. 10, 1997 [EP] European Pat. Off. ..... 97200354

[51] Int. Cl.[6] ..... H01J 29/70; G09G 3/22

[52] U.S. Cl. ..... 313/422; 313/495; 313/103 CM; 313/105 CM; 345/74

[58] Field of Search ..... 313/422, 103 CM, 313/105 CM, 489, 495, 496, 106, 107, 479, 460; 345/74, 75, 47

[56] References Cited

U.S. PATENT DOCUMENTS

| | | | |
|---|---|---|---|
| 5,497,046 | 3/1996 | Van Gorkom et al. | 313/422 |
| 5,557,296 | 9/1996 | Lambert et al. | 313/422 X |
| 5,625,253 | 4/1997 | Van Gorkom et al. | 313/495 X |
| 5,637,954 | 6/1997 | Van Gorkom et al. | 313/422 |
| 5,721,468 | 2/1998 | De Zwart et al. | 313/103 CM X |
| 5,798,605 | 8/1998 | Lambart et al. | 313/105 CM X |
| 5,811,919 | 9/1998 | Hoogsten et al. | 313/422 |
| 5,811,921 | 9/1998 | Lightart et al. | 313/422 |
| 5,844,354 | 12/1998 | De Zwart et al. | 313/105 CM X |
| 5,861,709 | 1/1999 | Lobi et al. | 313/422 |

FOREIGN PATENT DOCUMENTS

WO9321650 10/1993 WIPO ..... H01J 29/70

*Primary Examiner*—Ashok Patel
*Attorney, Agent, or Firm*—Robert J. Kraus

[57] ABSTRACT

Thin-panel picture display device having a luminescent screen and a large emitting plane electron source, such as a large number of juxtaposed electron propagation ducts operating by means of wall interaction of electrons. By means of an addressing system, electrons extracted from ducts are directed towards desired locations on the luminescent screen. The addressing system comprises a preselection system and a fine-selection system with an intermediate spacer plate of insulating material provided with apertures for passing electrons arranged in between. To provide the possibility of applying large voltage differences across the thickness of the spacer plate, the walls of the apertures are at least partly coated with a coating of a low δ material having a low secondary emission coefficient ($\delta_{max} \leq 3.5$), particularly $Si_3N_4$, AlN, $Cr_2O_3$ or $Y_2O_3$.

10 Claims, 4 Drawing Sheets

PICTURE DISPLAY DEVICE WITH ADDRESSING SYSTEM

BACKGROUND OF THE INVENTION

The invention relates to a picture display device having a vacuum envelope which is provided with a transparent face plate and a display screen having a pattern of luminescent pixels, and with a rear wall, comprising a large emitting plane electron source, an addressing system arranged between said large emitting plane electron source and the face plate so as to address desired pixels, said addressing system comprising a preselection system and a fine-selection system, and, at a position between said selection systems, an intermediate spacer which, adjacent to the preselection system, comprises a first apertured intermediate plate of insulating material provided with apertures for passing electrons.

The display device described above may be of the thin-panel type, an embodiment of which is disclosed in U.S. Pat. No. 5,497,046 (=PHN 14.374). Display devices of the thin-panel type are devices having a transparent face plate and, arranged at a small distance therefrom, a rear plate, while a (for example, hexagonal) pattern of phosphor dots is provided on the inner surface of a face plate. If (video information-controlled) electrons impinge upon the luminescent screen, a visual image is formed which is visible via the front side of the face plate. The face plate may be flat or, if desired, curved (for example spherical or cylindrical). Another embodiment is disclosed in WO 93/21650.

The display device described in U.S. Pat. No. 5,497,046 comprises as a large emitting plane electron source a plurality of juxtaposed sources for emitting electrons, local electron propagation means cooperating with the sources, each having a wall of a high-ohmic, substantially insulating material having a secondary emission coefficient which is suitable for propagating emitted electrons, and an addressing system comprising electrodes (selection electrodes) which can be driven row by row so as to extract electrons from the propagation means at predetermined extraction locations facing the luminescent screen, while further means are provided for directing extracted electrons towards pixels of the luminescent screen for producing a picture composed of pixels.

The operation of the picture display device disclosed in U.S. Pat. No. 5,497,046 is based on the recognition that electron propagation is possible when electrons impinge on a wall of a high-ohmic, substantially insulating material (for example, glass or synthetic material), if an electric field of sufficient power is generated over a given length of the wall (by applying a potential difference across the ends of the wall). The impinging electrons generate secondary electrons by wall interaction, which electrons are attracted to a further wall section and in their turn generate secondary electrons again by wall interaction, and so forth.

Starting from the above-mentioned principle, a thin-panel picture display device can be realized by providing each one of a plurality of juxtaposed "compartments", which constitute propagation ducts, with a column of extraction apertures at a side which is to face a display screen. It will then be practical to arrange the extraction apertures along "horizontal" lines extending transversely to the ducts. By adding selection electrodes arranged in rows to the arrangement of apertures, an addressing means is provided with which electrons can be selectively extracted from the "compartments", which electrons can be directed (and accelerated) towards the screen for producing a picture composed of pixels by activating the pixels.

A multistage addressing system (or selection system) is particularly described in U.S. Pat. No. 5,497,046. A multistage selection system with a number of preselection extraction locations reduced with respect to the number of pixels and, directly or indirectly added thereto, a number of (fine-) selection apertures corresponding to the number of luminescent pixels provides advantages for, for example the extraction efficiency and/or the required number of connections/drivers. A pattern of preselection electrodes is used for driving the preselection extraction locations and a pattern of fine-selection electrodes is used for driving the (fine-)selection apertures.

An important component of the known display device, the screen spacer, is adjacent to the luminescent screen.

The screen spacer is arranged between the fine-selection electrodes and the luminescent screen. Due to the efficiency and the saturation behavior of the luminescent material (the phosphor), it is important that the voltage between the screen and the fine selection is as high as possible. Dependent on the phosphors used, 3 kV or, more frequently, 5 kV is a minimum requirement.

The fine-selection plate, the screen spacer and the face plate are made of an insulating material, particularly glass. A patterned metallization of, for example nickel is provided on the fine-selection plate. A low-ohmic transparent conducting layer of, for example ITO is provided on the face plate. The luminescent material and (possibly) a black matrix are provided on this layer. A typical thickness of the screen spacer is 0.3 or 0.4 to 1.0 mm. A further spacer, referred to as the intermediate spacer, is arranged at a position between the preselection system and the fine-selection system. This intermediate spacer may comprise one plate, or two co-operating plates each being apertured for passing electrons. In the known display devices of the type described, an aperture is often constituted by two interconnected cavities, the cavity at the electron entrance side of an aperture being generally wider than the cavity at the electron exit side.

To transport electrons from the electron propagation ducts to the luminescent screen, a voltage difference between these components is necessary. Thus, in operation, there is also a voltage difference across the (thickness of) the intermediate spacer. In practice, the voltage stability of the intermediate spacer, or of the intermediate plate or plates, appears to be a problem. A breakdown may occur. The intermediate spacer is used, inter alia, for reducing the (position-dependent) voltage difference between preselection and further selection (the further selection may be the fine selection, or possibly a previous intermediate selection).

SUMMARY OF THE INVENTION

It is an object of the invention to provide a display device of the type described in the opening paragraph, in which the intermediate spacer is implemented in such a way that breakdown is wholly or partly prevented.

To this end, a display device of the type described in the opening paragraph is characterized in that the side walls of the apertures in the first intermediate plate are at least partly coated with a coating having a maximal secondary emission coefficient of at most 3.5 (and particularly less than 3).

The invention is based on the recognition that, with the use of intermediate spacers, field amplification may occur on the side-wall portions of the apertures which are situated close to the metallization pattern (the preselection electrodes) of the subjacent plate. As a result of this field amplification on the side walls, field emission occurs which may give rise to breakdown. The above-mentioned phenomenon is prevented by providing a coating of a material having a low value of the secondary electron emission on at least said side-wall portions. In the conventional intermediate spacers, with apertures of the type having side walls and a bottom in which a subsequent, smaller, aperture terminates, the coating of the side walls presents problems when one does not want to cover the bottoms. These bottoms are preferably left uncovered in connection with the electron transport through the apertures.

In a preferred embodiment of the display device which is characterized in that the apertures are tapered and of the type without a bottom, i.e. their side walls extend monotonously from the aperture entrance to the aperture exit, this problem does not occur. By spraying the intermediate spacer at the entrance side of the apertures with a suspension of a low δ material, the spacer surface at that side and also a part of the side walls of the apertures are coated. If the coating material has a sufficiently high resistance ($>10^{10}$ Ω/□), it simultaneously functions as a high-ohmic layer on the electron entrance side of the intermediate spacer. Such a high-ohmic layer at that position has given advantages, particularly when the plates are not positioned exactly flat on each other. Intermediate spacers (with one or two intermediate plates) manufactured in this way were found to have a very high voltage stability (up to typically 5 kV and more).

It has been found that a coating comprising a nitride, an oxynitride and/or a metal oxide yields $\delta_{max}$ values of $\leqq 3.5$ and particularly less than 3, in combination with electric resistances of more than $10^{10}$ Ω/□, and particularly more than $10^{12}$ Ω/□ are feasible, which are eminently suitable for the object of the invention.

$Si_3N_4$, AlN, $Cr_2O_3$ and $Y_2O_3$ have been found to be particularly suitable because they appear to have an extra high stability (particularly of the electrical resistance) during electron bombardment occurring in a display, as compared with other materials also satisfying the resistance and $\delta_{max}$ requirements such as $Ta_2O_5$ and $TiO_2$.

The required coatings may be provided by means of plasma CVD or (rf or dc) magnetron sputtering. Generally, the surface of the plate and the walls of the apertures are coated therewith, while leaving the choice of coating at one or two sides. Generally, the coating of the walls of the apertures appears to be thinner than that of the plate surfaces.

Sputtering and vapor deposition lead to homogeneous coatings. To obtain a coating having a minimal δ, it appears to be efficient to provide a particle coating instead of a homogeneous coating. Preferably, these particles have dimensions in the micron or sub-micron range. An additional advantage is that such particle coatings can be provided in a relatively simple manner by spraying a suspension containing the particles.

A further advantage is that a satisfactory wall coating of the apertures can be realized by spraying a suspension, which is more difficult to realize by means of vapor deposition and sputtering.

Alternatively, the desired particles can be provided by means of a phototacky process.

The preselection system generally comprises an insulating preselection plate with preselection apertures. This plate is situated at the display screen side of the electron propagation ducts and has a pattern of preselection electrodes extending along the apertures. The tapered apertures of the first intermediate plate of the intermediate spacer are preferably dimensioned in such a way that they are larger at their electron entrance side than the corresponding preselection apertures at their electron exit side. This is a useful measure for preventing current from being left behind on the preselection electrodes. Electrons may also be left behind when the passage of electrons from the preselection plate would be hindered. For this reason, not only the apertures of the first intermediate plate should be preferably larger than the preselection apertures, but particularly so large that the low δ coating provided on their side walls is "out of sight" of the passing electrons. A low δ coating may charge negatively and therefore tends to inhibit the passage of electrons. Since there is no space to give the apertures an arbitrary large size, it is advantageous when the preselection apertures themselves are relatively small.

The intermediate spacer may not only comprise the first intermediate plate but also a second intermediate plate situated at the display screen side. Such a second intermediate plate has apertures which serve as "funnels" for the subsequent selection (fine selection or possibly intermediate selection). Notably in the case where no metallization pattern is provided on the first intermediate plate, and/or the first intermediate plate has a sufficiently high voltage stability, the second intermediate plate does not need to comply with special requirements imposed on the voltage stability. This means that a low δ coating does not necessarily have to be provided. It is advantageous to coat the entrance surface of the second intermediate plate with a high δ coating such as MgO. This enhances the electron transport and inhibits or prevents degradation of the (glass) intermediate plate during electron bombardment. The apertures in the second intermediate plate are preferably tapered with a monotonous shape of the side walls. Such apertures can be easily made by means of a powder-spraying process, while for the function they have to fulfil they may extend from wide to narrow, or from narrow to wide.

These and other aspects of the invention, which also relates to an addressing system, as described above, for a display device, are apparent from and will be elucidated with reference to the embodiments described hereinafter.

BRIEF DESCRIPTION OF THE DRAWINGS

In the drawings.

Identical components are denoted by the same reference numerals.

BRIEF DESCRIPTION OF THE PREFERRED EMBODIMENTS

Figure 1:
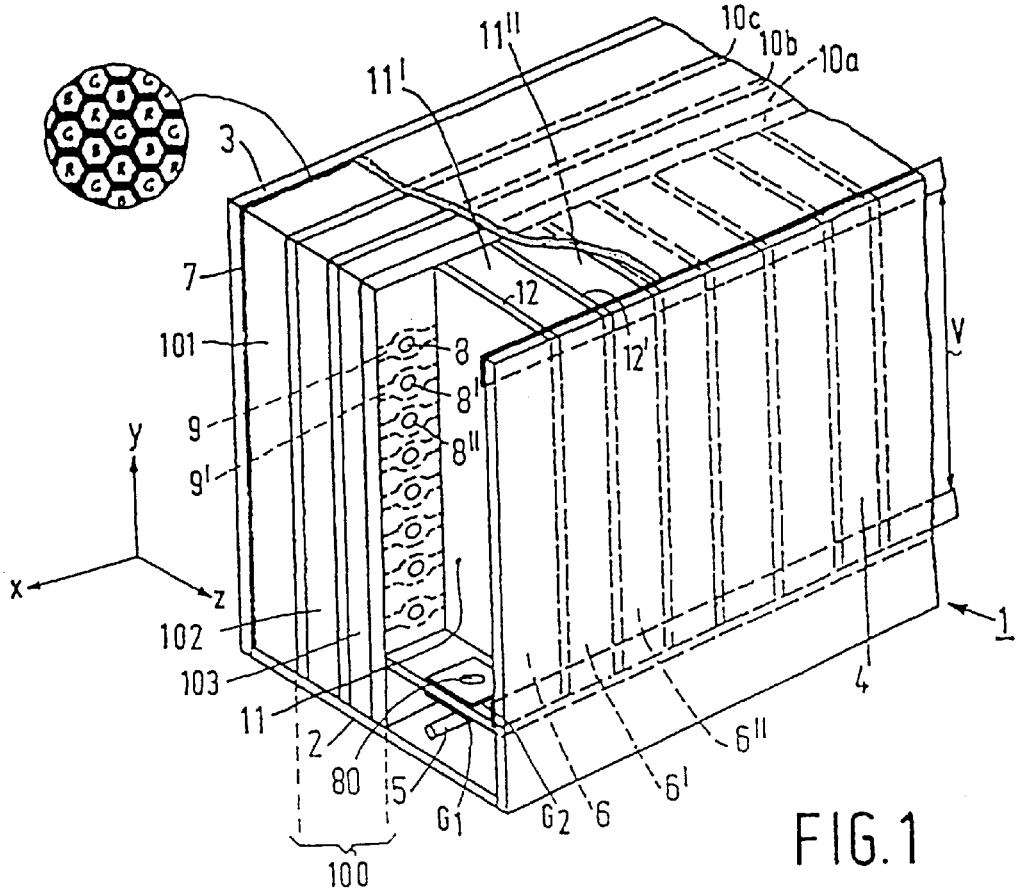
FIG. 1 is a diagrammatic perspective elevational view, partly broken away, of a part of a (color) display device with electron propagation ducts, an addressing system with an apertured preselection plate, an apertured fine-selection plate and a screen spacer whose components are not shown to scale.

FIG. 1 shows a flat-panel picture display device having a display panel (window) 3 and a rear wall 4 located opposite said panel. A display screen 7 having a (for example, hexagonal) pattern of red (R), green (G) and blue (B) luminescing phosphor pixels is arranged on the inner surface of window 3. In the embodiment shown, triplets of phosphor elements are arranged in tracks transverse to the long axis of the display screen (i.e. "vertically staggered", see inset) but the invention is not limited thereto. For example, a horizontally staggered arrangement is also possible.

An electron source arrangement 5, for example a line cathode which by means of electrodes provides a large number of electron emitters, for example 600, or a similar number of separate emitters, is arranged proximate to a wall 2 which interconnects panel 3 and rear wall 4. Each of these emitters is to provide a relatively small current so that many types of cathodes (cold or hot cathodes) are suitable as emitters. The emitters may be driven by a video drive circuit. The electron source arrangement 5 is arranged opposite entrance apertures of a row of electron propagation ducts extending substantially parallel to the screen, which ducts are constituted by compartments 6, 6', 6", . . . etc., in this case one compartment for each electron source. These compartments have cavities 11, 11', 11", . . . defined by the rear wall 4 and partitions 12, 12', . . . . The cavities 11, 11', . . . may be alternatively provided in the rear wall 4 itself. At least one wall (preferably the rear wall) of each compartment should have a high electrical resistance in at least the propagation direction, which resistance is suitable for the purpose of the invention, and a secondary emission coefficient $\delta>1$ over a given range of primary electron energies (suitable materials are, for example, ceramic material, glass, synthetic material—coated or uncoated). An axial propagation field is generated in the compartments by applying a potential difference $V_P$ across the height of the compartments 6, 6', 6", . . . .

The electrical resistance of the wall material has such a value that a minimum possible total amount of current (preferably less than, for example 10 mA) will flow in the walls at a field strength in the axial direction in the compartments of the order of one hundred to several hundred volts per cm required for the electron propagation. By applying a voltage of the order of several dozen to several hundred volts (value of the voltage is dependent on circumstances) between the row 5 of electron sources and the compartments 6, 6', 6", electrons are accelerated from the electron sources towards the compartments, whereafter they impinge upon the walls in the compartments and generate secondary electrons.

Figure 2:
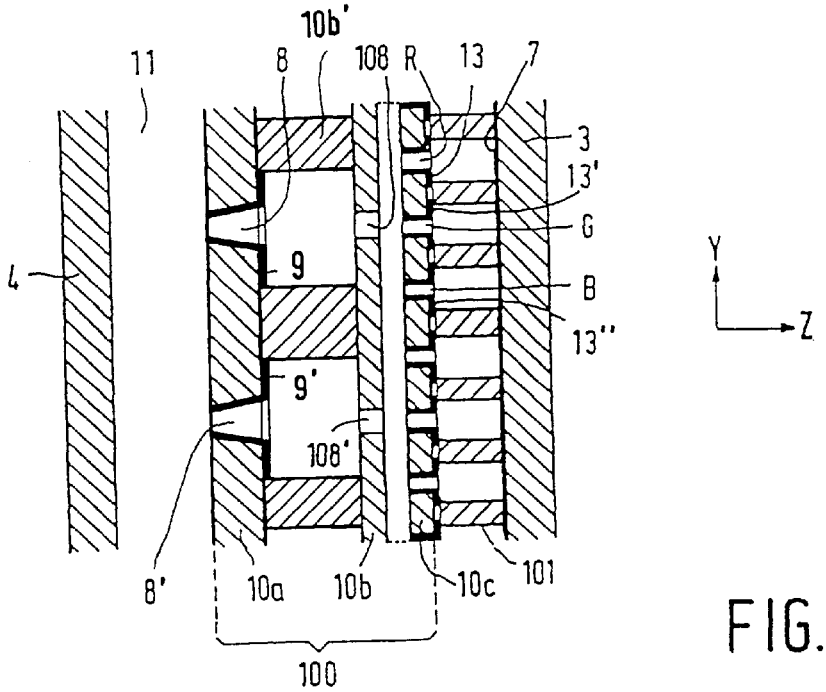
FIG. 2 is a diagrammatic cross-section through a part of a device of the type shown in FIG. 1.

The space between the compartments and the luminescent screen 7, which is arranged on the inner wall of panel 3, accommodates a (stepped) addressing system 100 which comprises an (active) preselection plate 10*a*, a (passive) obstruction plate 10*b* and an (active) (fine-)selection plate 10*c* (see also FIG. 2). Structure 100 is separated from the luminescent screen 7 by a screen spacer 101 formed as an apertured plate of insulating material.

FIG. 2 shows in a diagrammatical cross-section a part of the display device of FIG. 1 in greater detail, particularly the addressing structure 100 comprising preselection plate 10*a* with apertures 8, 8', 8", . . . , and fine-selection plate 10*b* with groups of apertures R, G, B. Three fine-selection apertures R, G, B are associated with each preselection aperture 8, 8', etc. in this case. In the diagrammatic FIG. 2, the apertures R, G, B are coplanar. However, in reality they are arranged in a configuration corresponding to the phosphor dot pattern (see FIG. 1). In this case, an intermediate spacer configuration 10*b*, 10*b'* comprising a preselection spacer plate 10*b'* having large apertures and an obstruction spacer plate 10*b* having smaller apertures 108, 108", . . . is arranged between the preselection plate 10*a* and the fine-selection plate 10*c*. Plate 106 prevents electrons from the propagation ducts 11 from impinging upon the display screen straight through a fine-selection aperture (known as unwanted "direct hits").

Electron propagation ducts 6 with transport cavities 11, 11', . . . are formed between the structure 100 and rear wall 4. To be able to extract electrons from the ducts 6 via the apertures 8, 8', . . . , addressable, metal preselection electrodes 9, 9', etc. extending from aperture to aperture and surrounding the apertures are arranged in ("horizontal") rows parallel to the long axis of the display screen on, for example the display screen side of the plate 10*a*.

The walls of the apertures 8, 8', . . . may be metallized.

Similarly as the plate 10*a*, the fine-selection plate 10*c* is provided with "horizontally oriented" addressable rows of (fine-)selection electrodes for realizing fine selection. The possibility of directly or capacitively interconnecting corresponding rows of fine-selection electrodes is important in this respect. In fact, a preselection has already taken place and, in principle, electrons cannot land at the wrong location. This means that only one group, or a small number of groups of three separately formed fine-selection electrodes is required for this mode of fine selection.

The preselection electrodes 9, 9', . . . are subjected to a linearly increasing DC voltage, for example by connecting them to a voltage divider. The voltage divider is connected to a voltage source in such a way that the correct potential distribution to realize electron transport in the ducts is produced across the length of the propagation ducts. Driving is effected, for example by applying a pulse (of, for example 250 V) for a short period of time to consecutive preselection electrodes and to apply shorter lasting pulses of, for example 200 V to the desired fine-selection electrodes. It should of course be ensured that the line selection pulses are synchronized with the video information. The video information is applied, for example to the individual $G_1$ electrodes which drive the emitters (FIG. 1), for example in the form of a time or amplitude-modulated signal.

It should be noted that several variants of the intermediate spacer configuration comprising the preselection spacer plate 10*b'* and the obstruction spacer plate 10*b* as shown in FIG. 2 are possible. For example, the plate 10*b* may be combined with spacer plate 10*b'* to one unit. The obstruction spacer plate is alternatively referred to as "chicane" spacer. When high transport voltages are used in the display, two of these combinations may be used one behind the other.

FIG. 2 shows a diagrammatic construction in which always one preselection aperture is associated with three fine-selection apertures. A practical alternative is a construction having half the number of preselection apertures (viewed in the longitudinal direction of the propagation ducts), in which each preselection aperture is associated with two intermediate selection apertures which are separately addressable, and in which each intermediate selection aperture is associated with three fine-selection apertures. This simplifies the preselection drive circuit to a great extent. (Another construction of intermediate selection apertures and fine-selection apertures is of course also possible, as well as an even further reduction of the number of preselection apertures per column, and the application of two intermediate selection steps).

Figure 3:
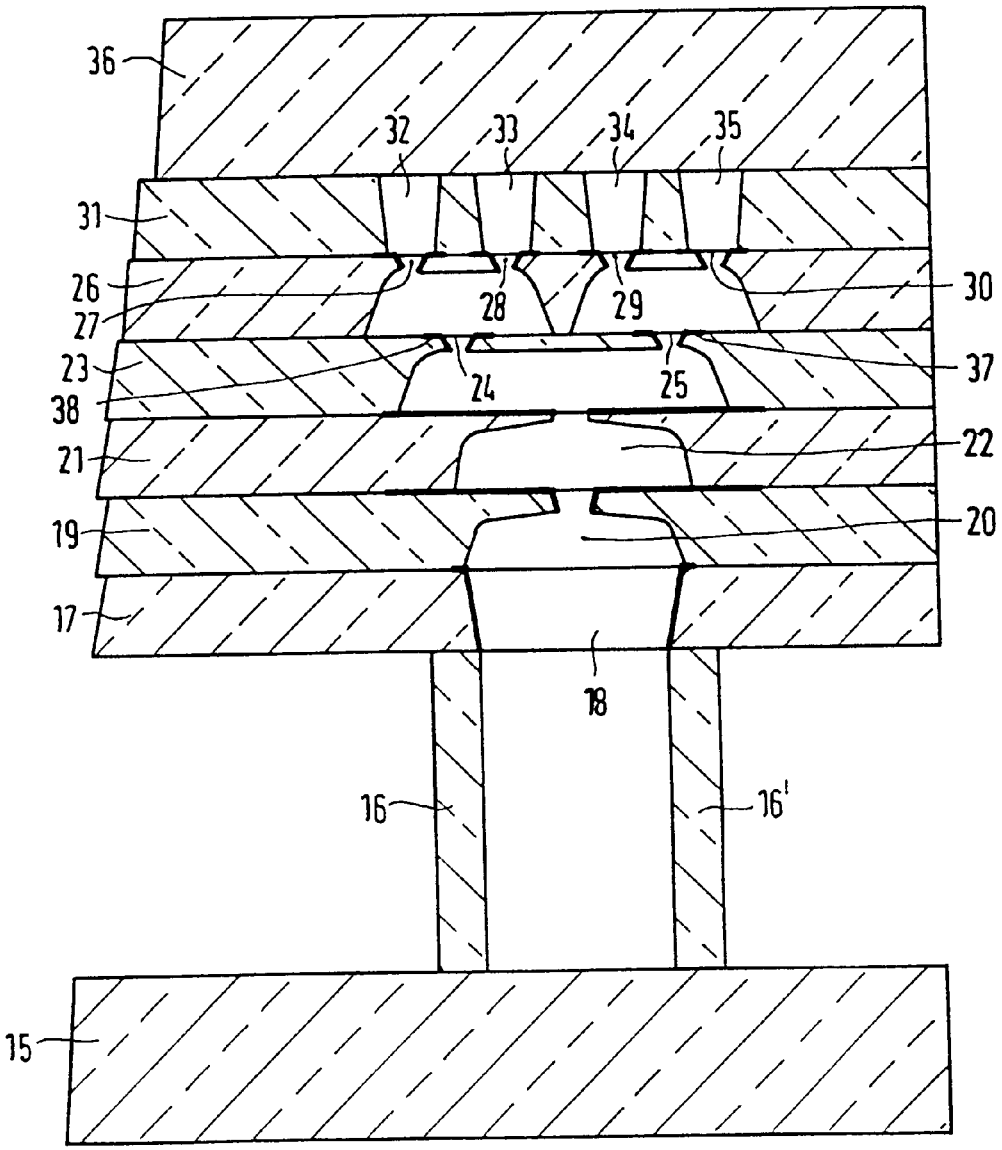
FIG. 3 is a cross-sectional view of a part of a device as shown in FIG. 1, but in greater detail.
Figure 4:
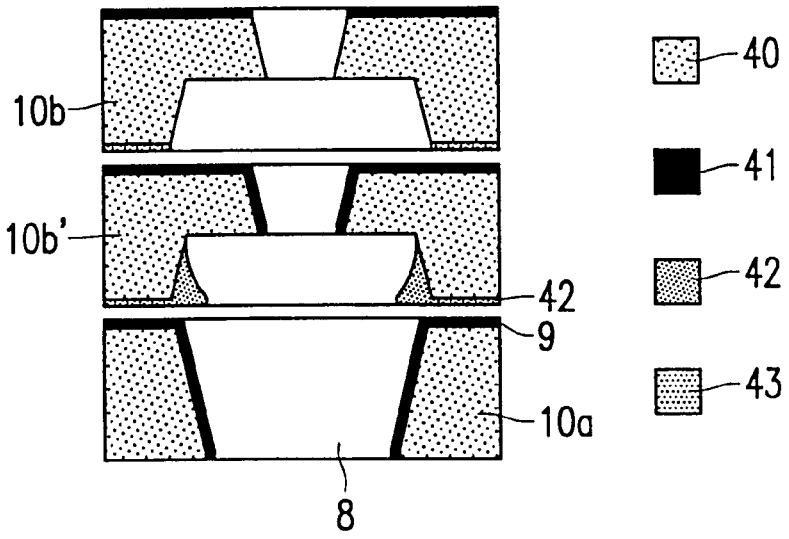
FIGS. 4, 5, 6 and 7 show embodiments of intermediate spacers in cross-sectional views.

An embodiment of a construction in which the above-mentioned concept is used is shown in a diagrammatic cross-section in FIG. 3. This Figure shows a propagation duct rear wall 15, duct intermediate walls 16, 16', a preselection plate 17 with a preselection aperture 18, a first intermediate plate 19 with an aperture 20 extending from wide to narrow, a second intermediate plate 21 with an aperture 22 extending from wide to narrow, an obstruction plate annex intermediate selection plate 23 with (intermediate selection) apertures 24 and 25 which are associated via apertures 20 and 23 with aperture 18 and are separately addressable by means of intermediate selection electrodes 36 and 37, a fine-selection plate 26 with a first pair of three fine-selection apertures which are associated with intermediate selection aperture 24 (only the apertures 27 and 28 of this pair are visible) and a second pair of three fine-selection apertures which are associated with intermediate selection aperture 25 (only the apertures 29 and 30 of this pair are visible), a screen spacer plate 31 with (conical) apertures 32, 33, 34 and 35 which correspond to the apertures 27, 28, 29 and 30, and a front panel 36 whose inner side is provided with a phosphor pattern. This stack of (eight) plates particularly leads to a satisfactorily operating display if all plates are made of borosilicate glass.

When electrons are passed through the apertures in the first intermediate plate of the intermediate spacer, the side walls of the apertures can be charged. This charging may give rise to breakdown. It appears to be favorable to ensure that the walls of the spacer apertures are poor secondary emitters, by providing a coating 18 having a secondary emission coefficient $\delta_{max}$ which is particularly smaller than that of glass. In practice, coatings of $1 \leqq \delta_{max} \leqq 3.5$ are suitable and particularly $\delta_{max} \leqq 3$. Of the materials having a satisfactory resistance against electron bombardment, for example AlN has $\delta_{max}$ values in the higher part of this range, $Si_3N_4$ has $\delta_{max}$ values in the central part and $Y_2O_3$ and $Cr_2O_3$ have $\delta_{max}$ values in the lower part. Said coating should preferably have a sufficiently high-ohmic value so that the entrance side of the spacer is not "short-circuited" with the exit side. FIGS. 4, 5, 6 and 7 show where the different coatings should be present on the glass plates 40. In addition to the "low δ" coating 42 discussed here, which may be provided on the entire entrance spacer surface (in practice, this is often simpler than providing the coatings on the aperture walls only), these are metallization patterns 41 and possibly high δ coatings 43. Low δ coatings may be provided by means of many techniques.

a) Low δ $Si_3N_4$ coatings

Since no $Si_3N_4$ precursors are known, it is not possible to provide thin, homogeneous layers wet-chemically. A suitable way of making $Si_3N_4$ coatings (other than by sputtering or vapor deposition) appears to be the provision of particle coatings by means of spraying. Such coatings had a $\delta_{max}$ of between 2.2 and 2.8 and a resistance of at least $5\times10^{13}$ Ω/□.

b) Low δ AlN coatings

Sputtered AlN coatings had a resistance per square of approximately $10^{13}$ Ω/□ and a $\delta_{max}$ of approximately 3.3. For sprayed AlN coatings, resistances in the range between $10^{13}$ and $10^{15}$ Ω/□ and $\delta_{max}$ values of approximately 3 were found.

c) Low δ $Y_2O_3$ coatings $Y_2O_3$ particle coatings yield a $\delta_{max}$ of less than 2, which is smaller than the $\delta_{max}$ of sputtered and vapor-deposited coatings and coatings made by means of a Y precursor. Moreover, in contrast to Y precursors (often used in an alcoholic medium) an aqueous medium can be used. Resistances of $\geqq 10^{14}$ Ω/□ were found.

Figure 5:
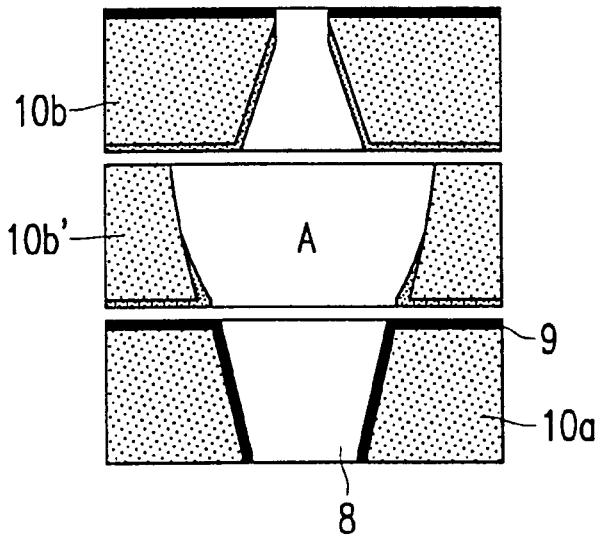
Figure 6:
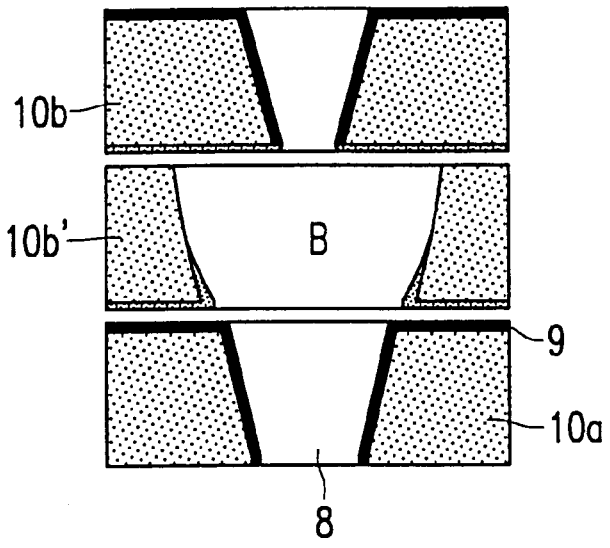
Figure 7:
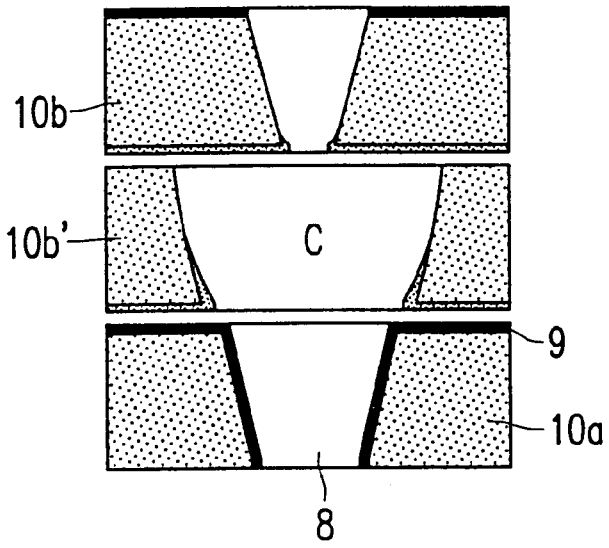

FIGS. 4, 5, 6 and 7 show different configurations of a preselection plate 10*a* with a (first) intermediate plate 10*b'*, and possibly a (second) intermediate plate 10*b*. At the entrance side, intermediate plate 10*b'* in FIG. 4 has a wide aperture with a bottom and, at the exit side, a narrower aperture terminating in the bottom. A low δ coating is provided on the side wall of the entrance aperture. Intermediate plate 10*b* has the same aperture configuration and may serve in this composition for compensating larger transport voltages in the display. Since it is difficult to keep the bottoms of the entrance apertures free from a coating, the embodiments of FIGS. 5, 6 and 7 are preferred. These embodiments have a first intermediate plate 10*b'* with a single tapered aperture which widens from the entrance side to the exit side. Here again, a low δ coating is provided on at least a part of the side walls. The second intermediate plate 10*b* differs from case to case. The apertures are tapered and narrow towards the display screen (FIG. 5) or may alternatively widen towards the display screen (FIGS. 6, 7). Metallization patterns may be provided only on the exit surface (FIGS. 5, 7) or also on the walls of the apertures.

Intermediate plate 10*b* only serves as a "funnel" for the subsequent selection plate and does not need to comply with special requirements imposed on the voltage stability. In principle, this plate could be coated with a high δ layer such as MgO. This enhances the transport and inhibits or prevents degradation. Many implementations are feasible for intermediate plate 10*b;* the Figures show different, but by no means all, options. Option A was tested and appeared to have a very high voltage stability. Voltage differences up to at least 4.5 kV are possible. 2 kV is the limit for intermediate plate 10*b* with the geometry of FIG. 4 (the old geometry). Option B was also tested and yielded comparable results as option A, but was more attractive from a technological point of view. Option C is a good alternative. An intermediate plate 10*b* implemented as intermediate plate 10*b* or 10*c* of the old geometry (FIG. 4) is also possible (and tested). If desired, intermediate plate 2 may be left out altogether.

In summary, the invention relates to a thin-panel picture display device having a luminescent screen and a large emitting plane electron source, such as a large number of juxtaposed electron propagation ducts operating by means of wall interaction of electrons. By means of an addressing system, electrons extracted from ducts are directed towards desired locations on the luminescent screen. The addressing system comprises a preselection system and a fine-selection system with an apertured intermediate spacer plate of insulating material arranged in between for passing electrons. To provide the possibility of applying large voltage differences across the thickness of the spacer plate, the walls of the apertures are at least partly coated with a coating of a low δ material having a low secondary emission coefficient ($\delta_{max} \leqq 3.5$), particularly $Si_3N_4$, AlN, $Cr_2O_3$ or $Y_2O_3$.

We claim:

1. A picture display device having a vacuum envelope which is provided with a transparent face plate and a display screen having a pattern of luminescent pixels, and with a rear wall, comprising a large emitting plane electron source, an addressing system arranged between said large emitting plane electron source and the face plate so as to address desired pixels, said addressing system comprising a preselection system and a fine-selection system, and, at a position between said selection systems, an intermediate spacer which, adjacent to the preselection system, comprises a first intermediate plate of insulating material provided with apertures for passing electrons, characterized in that the side walls of the apertures in the first intermediate plate are at least partly coated with a coating having a maximal secondary emission coefficient of at most 3.5.

2. A display device as claimed in claim 1, characterized in that the coating is at least one representative of the group comprising $Si_3N_4$, AlN, $Cr_2O_3$ and $Y_2O_3$.

3. A display device as claimed in claim 1, characterized in that the coating is also provided on the surface of the first intermediate plate adjacent to the preselection system.

4. A display device as claimed in claim 1, characterized in that the apertures are tapered and the side walls of the apertures extend monotonously from the entrance sides of the apertures to the exit sides of the apertures.

5. A display device as claimed in claim 1, characterized in that the preselection system comprises a plate having preselection apertures which is adjacent to the first intermediate plate, and the apertures of the first intermediate plate are larger at their electron entrance side than the corresponding preselection apertures at their electron exit side.

6. A display device as claimed in claim 5, characterized in that the low δ coating is situated out of sight of electrons passing through the preselection apertures.

7. A display device as claimed in claim 1, characterized in that the intermediate spacer comprises a second apertured intermediate plate for passing electrons which is situated at the display screen side of the intermediate spacer.

8. A display device as claimed in claim 7, characterized in that the surface of the second intermediate plate adjacent to the first intermediate plate is provided with a high δ coating.

9. A display device as claimed in claim 8, characterized in that the apertures in the second intermediate plate are tapered, with monotonously extending side walls.

10. An addressing system for a display device, which addressing system comprises a preselection system and a fine-selection system, with an intermediate spacer at a position between these selection systems, which spacer, adjacent to the preselection system, comprises a first intermediate spacer plate of insulating material provided with apertures for passing electrons, characterized in that the side walls of the apertures in the first intermediate plate are at least partly coated with a coating having a maximal secondary emission coefficient of at most 3.5.

* * * * *